US007524799B2

(12) United States Patent
Chase et al.

(10) Patent No.: US 7,524,799 B2
(45) Date of Patent: Apr. 28, 2009

(54) PROCESS FOR PRODUCING HIGHLY SULFURIZED MOLYBDENUM OXYSULFIDE DITHIOCARBAMATES

(75) Inventors: Kevin J. Chase, Branford, CT (US); Ronald J. Tepper, Fairfield, CT (US)

(73) Assignee: R.T. Vanderbilt Company, Inc., Norwalk, CT (US)

( * ) Notice: Subject to any disclaimer, the term of this patent is extended or adjusted under 35 U.S.C. 154(b) by 677 days.

(21) Appl. No.: 11/297,039

(22) Filed: Dec. 8, 2005

(65) Prior Publication Data

US 2006/0199746 A1 Sep. 7, 2006

Related U.S. Application Data

(60) Provisional application No. 60/657,353, filed on Mar. 1, 2005.

(51) Int. Cl.
*C10M 135/18* (2006.01)

(52) U.S. Cl. ..... 508/363

(58) Field of Classification Search ..... 508/363; 556/38, 39
See application file for complete search history.

(56) References Cited

U.S. PATENT DOCUMENTS

| | | | | |
|---|---|---|---|---|
| 3,356,702 | A | 12/1967 | Farmer et al. | |
| 4,098,705 | A | 7/1978 | Sakurai et al. | 252/33.6 |
| 4,692,256 | A * | 9/1987 | Umemura et al. | 508/362 |
| 5,631,213 | A * | 5/1997 | Tanaka et al. | 508/363 |

* cited by examiner

*Primary Examiner*—Walter D Griffin
*Assistant Examiner*—Frank C Campanell

(57) ABSTRACT

A processes for preparing highly sulfurized molybdenum oxysulfide dithiocarbamates (Mo DTCs) by reacting: [A] a tertiary amine, [B] a hexavalent molybdenum compound, [C] carbon disulfide, [D] water, and [E] a secondary amine are disclosed. The Mo DTCs can be efficiently produced with high sulfur contents and in high yields with low corrosive action and excellent friction properties. The produced Mo DTCs can be used in either grease or lubricating oils as friction modifiers, antiwear agents, extreme pressure agents and antioxidants.

18 Claims, No Drawings

PROCESS FOR PRODUCING HIGHLY SULFURIZED MOLYBDENUM OXYSULFIDE DITHIOCARBAMATES

BACKGROUND OF THE INVENTION

1. Field of the Invention

The invention relates to highly sulfurized molybdenum oxysulfide dithiocarbamate compounds and processes for preparing same.

2. Discussion of the Prior Art

Molybdenum oxysulfide dithiocarbamates have been added to greases and lubricating oils for many years in order to improve extreme pressure properties, antiwear properties, antioxidancy, and for friction modification. There have been many methods described in the patent literature to prepare such materials.

U.S. Pat. No. 3,356,702 from Farmer et al. describes a method to prepare sulfurized molybdenum oxysulfide dithiocarbamates by solubilizing $MoO_3$ in water with an alkali metal hydroxide or ammonium hydroxide followed by neutralization with a mineral acid, then addition of $CS_2$ and a secondary amine.

U.S. Pat. No. 3,356,702 also describes a method in which $MoO_3$ or $MoO_2$ is placed in a polar solvent and the secondary amine and $CS_2$ are then added. Best results are obtained when at least 1.5 equivalents of amine relative to Mo are added to the reaction. This represents at least a 33% excess of amine. Sulfur levels are commonly around 25% by weight when the secondary amine used is dibutylamine.

U.S. Pat. No. 4,098,705 from Sakurai et al. describes a method to prepare highly sulfurized molybdenum oxysulfide dithiocarbamates by reacting a hexavalent molybdenum source with an alkali sulfide such as NaSH or $Na_2S$, followed by neutralization with a mineral acid, and addition of secondary amine and $CS_2$. Based on the elemental analyses in the examples, the material formed is highly sulfurized, between 27 and 30% sulfur by weight when the secondary amine used is dibutylamine. U.S. Pat. No. 5,631,213 from Tanaka et al. describes a method to prepare a highly sulfurized molybdenum oxysulfide dithiocarbamate similar to U.S. Pat. No. 4,098,705, but with the addition of a reducing agent.

SUMMARY OF THE INVENTION

It was the aim of the inventors to prepare a highly sulfurized molybdenum oxysulfide dithiocarbamate without the use either inorganic reagents (with the exception of Mo containing compounds), i.e. sodium hydrogensulfide, sulfuric acid, hydrochloric acid, etc. These reagents or their by-products could be carried over into the product with potential corrosion problems in its use as a lubricant additive, as well as safety issues in its production, especially with regard to the alkali sulfides, and the lowering of pH in the process, which could release toxic hydrogen sulfide gas. The removal of these reagents or their by-products could require extra processing as well as a possible increase in nonrecyclable wastes.

It was also the aim to prepare a highly sulfurized molybdenum oxysulfide dithiocarbamate in the most straightforward manner without the use of a large excess of secondary amine in order to improve throughput and efficiency.

It was also the aim in this process to potentially recycle all materials involved in the preparation of the highly sulfurized molybdenum oxysulfide dithiocarbamates.

It was also the aim to prepare a highly sulfurized molybdenum oxysulfide dithiocarbamate that utilizes the above and contains at least 27% sulfur by weight in the product when dibutylamine is used as the secondary amine.

It was also the aim to prepare highly sulfurized molybdenum oxysulfide dithiocarbamates that can be successfully added to lubricant compositions with excellent friction properties and low corrosivity.

The highly sulfurized molybdenum oxysulfide dithiocarbamates compounds of the invention have the following general formula:

(I)

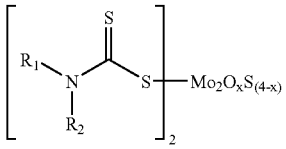

wherein $R_1$ and $R_2$ stand for a hydrocarbyl group having from 1 to 60 carbon atoms, $R_1$ and $R_2$ may be the same or different; x is a number from 0.5 to 2.5, preferably 0.7 to 2.2. One of the preferable groups for $R_1$ and $R_2$ in the general formula (I) is an alkyl group having from 1 to 60 carbon atoms, more preferably having from 2 to 18 carbon atoms, such as methyl, ethyl, n-propyl, isopropyl, n-butyl, isobutyl, tert-butyl, n-octyl, 2-ethylhexyl, n-nonyl, n-decyl, lauryl, stearyl, n-valeryl, isovaleryl, amyl, n-heptyl, tridecyl, and iso-heptyl groups. Another of the preferable groups for $R_1$ and $R_2$ in the general formula (I) is an alicyclic hydrocarbyl group, which may be substituted by an alkyl group, such as cyclohexyl group and 2-methyl cyclohexyl group. Yet another preferable group for $R_1$ and $R_2$ in the general formula (I) is an aromatic hydrocarbyl group such as benzyl, 4-methyl benzyl, 3-methoxybenzyl, 3,4-dimethoxybenzyl, and 4-ethoxyphenyl. Still another preferable group for $R_1$ and $R_2$ in the general formula (I) is a hydroxyalkyl group such as hydroxylethyl. Another preferable group is alkoxy, with one or more oxygens in the chain, such as methoxy, ethoxy, propoxy.

The solubility of the compound of this invention in mineral oils, grease and artificial lubricating oils such as polyethers, polyol esters, and polyesters, can be controlled, according to knowledge by those skilled in the art, by the kind of groups $R_1$ and $R_2$ in the general formula (I). For example, a compound which is very soluble in mineral oil is obtained by the use of the ditridecyl group.

Method A

A first embodiment of a process for preparing highly sulfurized molybdenum oxysulfide dithiocarbamates comprises the steps of, in order:

(1) reacting together: [A] a tertiary amine, [B] a hexavalent molybdenum compound and [C] water, to form a first reaction mixture (2) adding [D] carbon disulfide to the first reaction mixture to form a second reaction mixture; and then (2) adding [E] a secondary amine or secondary alkanolamine to the second reaction mixture.

Method B

Alternatively, a second embodiment of a process for preparing highly sulfurized molybdenum oxysulfide dithiocarbamates comprises the steps of reacting together, simultaneously: [A] a tertiary amine, [B] a hexavalent molybdenum compound, [C] water, [D] carbon disulfide and [E] a secondary amine or secondary alkanolamine. The order of addition is not particularly important here, but typically the volatile carbon disulfide is added last in order to better control any exothermic interactions between [A], [B], [C], [D] and [E].

DETAILED DESCRIPTION OF THE INVENTION

The present invention will be explained in detail, as follows.

Component [A] is a tertiary amine which can be represented by the general formula (II):

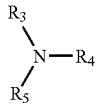

(II)

in which $R_3$, $R_4$, and $R_5$ are the same or different, and chosen from among alkyl, alkoxy, aryl, hydroxyalkyl, or alkylaryl. Examples include, but are not limited to trimethylamine, triethylamine, tripropylamine, triisopropylamine, dimethylethylamine, tributylamine, tripentylamine, trihexylamine, tricyclohexylamine, trioctylamine, trilaurylamine, tristearylamine, trioleylamine, tribenzylamine, dioleylmonoethanolamine, dilauryl-monopropanolamine, dioctylmonoethanolamine, dihexyl-monopropanolamine, dibutylmonopropanolamine, oleyldiethanolamine, stearyldipropanolamine, lauryldiethanolamine, octyldipropanolamine, butyldiethanolamine, benzyldiethanolamine, phenyldiethanolamine, tolyldipropanolamine, xylyldiethanolamine, triethanolamine and tripropanolamine. Component [A] is preferably triethylamine, tributylamine, or dimethylethanolamine.

Component [B] is a hexavalent molybdenum compound such as a metal salt of molybdic acid, ammonium molybdate, or molybdenum trioxide. Ammonium molybdate and molybdenum trioxide are preferred, because they do not contain any metal other than molybdenum. Component [C] is water. Component [D] is carbon disulfide.

Component [E] is a secondary amine or secondary alkanolamine, with the general structural formula (III),

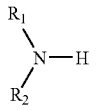

(III)

wherein $R_1$ and $R_2$ have the same meanings defined in the general formula (I). Preferably $R_1$ and $R_2$ are n-butyl, amyl, 2-ethylhexyl, or ditridecyl.

Solvent

In both methods a solvent can be employed as a processing aid. Examples of solvents that may be used in these processes include hydrocarbons such as hexanes, heptane, octane, nonane, decane, commercially available napthas and commercially available mineral oils. Alcohols, such as ethanol, n-propanol, isopropanol, butanol, isobutanol, sec-butanol, n-pentanol, n-hexanol, n-heptanol, n-octanol, 2-ethylhexanol can also be used.

In the present invention there are two general methods to produce highly sulfurized oxysulfide molybdenum dithiocarbamates, a first embodiment called Method A and a second embodiment called Method B.

Method A

This process involves three steps. The first step is the reaction of components [A], [B] and [C] at a moderate temperature, preferably between 15 and 100° C., to form a first reaction mixture. Optionally, a solvent may be added to aid in the process. The reaction takes between 15 minutes and 6 hours, preferably between 30 minutes and 3 hours. The molar ratio [A]/[B] can range from 5.0/1.0 to 0.25/1.0, preferably 3.0/1.0 to 1.0/1.0, and most preferably with 2.0/1.0. [C] is usually added in great molar excess, for example the molar ratio [B]/[C] is between 1.0/2.0 and 1.0/50.0, the preferred ratio being 1/25.0. All molar ratios set forth in herein are approximate, and slight deviations higher or lower would also be expected to work in line with the teachings of the invention. Therefore, it should be presumed that all ratios given are prefixed by the term 'about'.

In the second step, component [D] is then added to the first reaction product to form a second reaction mixture, and the mixture is heated to between 35 and 80° C. for a period between 1 and 4 hours, preferably at 40° C. and 2 hours. The molar ratio [B]/[D] can range from 1.0/1.5 to 1.0/5.0, preferably 1.0/1.6 to 1.0/2.5, with 1.0/2.0 most preferred.

In the third step, component [E] is then added to the second reaction mixture to form a third reaction mixture and the material is heated between 60 and 95° C. for a period between 1 and 5 hours, with a temperature of 70-100° C. and 3 hours preferred. The molar ratio between components [B] and [E] can range from 1.0/1.0 to 1.0/3.0, preferably 1.0/1.05 to 1.0/1.25, with 1.0/1.05 most preferred.

Depending on component [E] and the kind of highly sulfurized molybdenum dithiocarbamate prepared, the method of isolating the product from the third reaction mixture will differ, and the skilled person will be able to determine the appropriate method. For example, if $R_1$ and $R_2$ is butyl, then the solid product can be filtered out and washed with a solvent such as methanol, and the filtrate containing components [A], [C], and [D] can be recycled. If $R_1$ and $R_2$ are tridecyl, then components [A], [C], and [D] can be distilled from the liquid product and recycled.

Method B

In method B, components [A], [B], [C], [D] and [E] are simply added together. While the order of reaction is not essential, and the invention is intended to cover a combination of these reactants in general, it is preferred that the components [A], [B], [C], [E] be reacted together first, followed by [D]. [D] is added last as a safety measure to control any possible exothermic activity. A solvent (similar to solvents described above for Method A) can optionally be added at this stage to aid in the reaction. The reaction is then heated to between 40 and 100° C. for a period of between 2 and 10 hours. Then, the reaction is heated to a temperature between 90 and 150° C. for a period of between 1 and 10 hours to distill off the volatiles. The preferred temperatures are 85 and 120° C. for both heating steps, respectively. Triethylamine is the preferred component [A] in this method, and ditridecylamine and di-2-ethylhexylamine are the preferred components [E]. The molar ratios of [A], [B], [D], and [E] are: 0.25-5.0/1.0/1.5-5.0/1.0-3.0, preferably 0.25-3.0/1.0/1.5-3.0/1.0-2.0, with the preferred ratio being 0.50/1.0/1.6/1.05. [C] is usually added in great molar excess, for example the molar ratio [B]/[C] is between 1.0/2.0 and 1.0/50.0, the preferred ratio being 1/25.0.

EXAMPLES

Examples 1-16 illustrate various examples of production of a highly sulfurized molybdenum oxysulfide dithiocarbamate according to the novel methods of the invention. Examples 17-18 are comparative examples. Testing Examples 19-23 illustrate that the products manufactured according to the invention perform equally or better than the products manufactured according to prior art methods, while nevertheless avoiding the negative aspects of those prior art methods. Specifically, the resulting dithiocarbamates can be efficiently produced with high sulfur contents and in high yields with low corrosive action and excellent friction properties. The produced Mo DTCs can be used in either grease or lubricating oil compositions as friction modifiers, antiwear agents, extreme pressure agents and antioxidants. Lubricant compositions according to the invention may contain an effective amount of the dithiocarbamate product formed according to the invention, in amounts well known to those skilled in the art, e.g. as between 0.1 and 10 mole percent of the entire composition.

Example 1

Into a 250 mL round bottomed flask was added a magnetic stirring bar, 13.14 g (0.091 mol) of $MoO_3$, 18.44 g (0.182 mol) of triethylamine and 35 g of water. The mixture was stirred for 2 minutes, then 13.88 g (0.182 mol) of carbon disulfide was added, and the reaction mixture was heated at reflux for 1 hour. 11.00 g (0.070 mol) of diamylamine was then added, and the reaction was heated for 1 hour to give a yellow solid product which was washed with heptane and dried. Analysis (wt. %): C, 35.7; H, 6.2; N, 3.9; S, 26.1.

Example 2

Into a 500 mL round-bottomed flask equipped with a mechanical stirrer and thermometer was added 50.0 g (0.347 mol) of $MoO_3$, 124 g of n-octane, 70.1 g (0.695 mol) of triethylamine, and 30 g of water. With stirring, added 54.76 g (0.720 mol) of carbon disulfide and heated to 40-60° C. for 2 hours. 46.0 g (0.357 mol) of dibutylamine was added and heated at 80-85° C. for 1.5 hours. Heating was maintained at 90-100° C. for another 2 hours while collecting triethylamine, water, and unreacted carbon disulfide in a Dean Stark trap. The solid material was recovered by filtration, washed with methanol and dried to give 109.5 g of a yellow solid. Analysis (wt. %): C, 31.3; H, 5.2; N, 4.0; S, 27.5.

Example 3

Into a 500 mL round-bottomed flask equipped with a mechanical stirrer and thermometer was added 50.0 g (0.347 mol) of $MoO_3$, 124 g of n-propanol, 71.0 g (0.703 mol) of triethylamine, and 30 g of water. With stirring, heated the mixture for 30 minutes at 60° C. Next, added 54.76 g (0.720 mol) of carbon disulfide, at a temperature of 35-40° C., then heated at 40-45° C. for 1.25 hours. 46.0 g (0.455 mol) of dibutylamine was added, and the reaction was heated at 80-85° C. for 3 hours. The reaction was cooled, and the solid product was collected by filtration and washed with 3×50 mL of n-propanol and dried to give 109.0 g of a solid. Analysis (wt. %): C, 31.4; H, 6.7; N, 3.8, S, 27.3.

Example 4

Into a 500 mL round-bottomed flask equipped with a mechanical stirrer and thermometer was added 50.0 g (0.347 mol) of $MoO_3$, 124 g of n-propanol, 71.0 g (0.703 mol) of triethylamine, and 30 g of water. With stirring, heated the mixture for 30 minutes at 80° C. The reaction was cooled to 35° C., and 54.76 g (0.720 mol) of carbon disulfide was added, then the heated at 40-45° C. for 2.75 hours. 46.0 g (0.455 mol) of dibutylamine was added, and the reaction was heated at 80-85° C. for 3 hours. The reaction was cooled, and 6.0 g (0.079 mol) of carbon disulfide was then added, and the reaction heated at 80-85° C. for 1 hour. The reaction was cooled, and the solid product was collected by filtration and washed with 3×50 mL of n-propanol and dried to give 109.0 g of a solid. Analysis (wt. %): C, 31.0; H, 5.7; N, 3.9, S, 27.8.

Example 5

Into a 500 mL round-bottomed flask equipped with a mechanical stirrer and thermometer was added 50.0 g (0.347 mol) of $MoO_3$, 124 g of n-propanol, 64.4 g (0.348 mol) of tributylamine, and 30 g of water. With stirring, heated the mixture for 30 minutes at 80° C. The reaction was cooled to 35° C., and 55.00 g (0.724 mol) of carbon disulfide was added, then the heated at 40-45° C. for 1.75 hours. 46.0 g (0.455 mol) of dibutylamine was added, and the reaction was heated at 80-85° C. for 3.5 hours. The reaction was cooled, and the solid product was collected by filtration and washed with 3×50 mL of n-propanol and dried to give 114.35 g of a solid. Analysis (wt. %): C, 31.3; H, 5.4; N, 4.1, S, 27.2

Example 6

Into a 500 mL round-bottomed flask equipped with a mechanical stirrer and thermometer was added 16.20 g (0.113 mol) of $MoO_3$, 5.69 g (0.056 mol) of triethylamine, 27.00 g of water, 49.60 g (0.118 mol) of 91% ditridecylamine, and 34.56 g of a napthenic mineral oil. The mixture was stirred, and 17.0 g (0.224 mol) of carbon disulfide was added to the reaction mixture. The reaction was heated between 80 and 100° C. for a period of 9.75 hours. The volatiles were distilled off at 100° C., and the brown liquid that remained was filtered through Celite to give 99.37 g of product. Analysis (wt. %): Mo, 10.6; S, 8.2.

Example 7

Into a 500 mL round-bottomed flask equipped with a mechanical stirrer and thermometer was added 22.50 g (0.156 mol) of $MoO_3$, 8.67 g (0.086 mol) of triethylamine, 30.00 g of water, 2.58 g (0.016 mol) of diamylamine, 62.45 g (0.149 mol) of 91% ditridecylamine, and 45.67 g of a napthenic mineral oil. The mixture was stirred, and 23.7 g (0.312 mol) of carbon disulfide was added to the reaction mixture. The reaction was heated at reflux for a period of 10 hours. The volatiles were distilled off at 100° C., and the reaction was heated at 120-130° C. for a period of 30 minutes to assure loss of volatiles. The brown liquid was filtered through Celite to give 157.00 g of product. Analysis (wt. %): Mo, 10.6; S, 10.3.

Example 8

Into a 500 mL round-bottomed flask equipped with a mechanical stirrer and thermometer was added 50.0 g (0.347 mol) of $MoO_3$, 73 g of isopropanol, 71.0 g (0.703 mol) of triethylamine, and 30 g of water. With stirring, the mixture was heated for 30 minutes at 80° C. The reaction was cooled to 35° C., and 66 g (0.868 mol) of carbon disulfide was added, then the heated at 40-45° C. for 2 hours. 46.0 g (0.356 mol) of dibutylamine was then added, and the reaction was heated at 73° C. for 5 hours. The reaction was cooled, and the solid product was collected by filtration and washed with 2×100 mL of isopropanol/water and dried to give 100 g of a yellow solid. Analysis (wt. %): C, 31.4; H, 5.2; N 3.9; S 28.5.

Example 9

Into a 500 mL round-bottomed flask equipped with a mechanical stirrer and thermometer was added 50.0 g (0.347 mol) of $MoO_3$, 73 g of isopropanol, 71.0 g (0.703 mol) of triethylamine, and 50 g of water. With stirring, the mixture was heated for 30 minutes at 80° C. The reaction was cooled to 35° C., and 66 g (0.868 mol) of carbon disulfide was added, then the heated at 40-45° C. for 3 hours. 47.0 g (0.364 mol) of dibutylamine was then added, and the reaction was heated at 76° C. for 6 hours. The reaction was cooled, and the solid product was collected by filtration and washed with 2×100 mL of isopropanol/water and dried to give 100 g of a yellow solid. Analysis (wt. %): C, 31.6; H, 5.7; N 4.2; S 27.5. The filtrate was recovered and reused in Example 11.

Example 10

This was performed similarly to example 9 and yielded 95 g of a yellow solid. Analysis (wt. %): C, 31.4; H, 5.2; N, 4.2; S 28.3.

Example 11

Into a 250 mL round-bottomed flask equipped with a mechanical stirrer and thermometer was added 25.0 g (0.174 mol) of $MoO_3$ and 90 g of the filtrate from Example 9. With stirring, the mixture was heated for 30 minutes at 80° C. The reaction was cooled to 35° C., and 19.9 g (0.262 mol) of carbon disulfide was added, then the heated at 40-45° C. for 3 hours. 23.0 g (0.178 mol) of dibutylamine was then added, and the reaction was heated at 76° C. for 7 hours. The reaction was cooled, and the solid product was collected by filtration and washed with 2×100 mL of isopropanol/water and dried to give 60.0 g of a yellow solid. Analysis (wt. %): C, 31.4; H, 5.2; N, 4.2; S 27.8.

Example 12

Into a 500 mL round-bottomed flask equipped with a mechanical stirrer and thermometer was added 50.0 g (0.347 mol) of $MoO_3$, 33 g of isopropanol, 71.0 g (0.703 mol) of triethylamine, and 60 g of water. With stirring, the mixture was heated for 20 minutes at 80° C. The reaction was cooled to 35° C., and 66 g (0.868 mol) of carbon disulfide was added, then the heated at 40-45° C. for 3 hours. 47.0 g (0.364 mol) of dibutylamine was then added, and the reaction was heated at 75° C. for 4 hours. The reaction was cooled, and the solid product was collected by filtration and washed with 2×100 mL of isopropanol/water and dried to give 105 g of a yellow solid. Analysis (wt. %): C, 31.5; H, 4.5; N 4.2; S 27.6.

Example 13

Into a 250 mL round-bottomed flask equipped with a mechanical stirrer and thermometer was added 25.0 g (0.174 mol) of $MoO_3$, 62 g of isopropanol, 32.0 g (0.360 mol) of dimethylethanolamine, and 15.0 g of water. The mixture was heated to 80° C. for 40 minutes, then the reaction was cooled to 35° C., and 29.1 g (0.383 mol) of carbon disulfide was added. The reaction was maintained at 40-45° C. for a period of 3 hours, then 32.0 g of dibutylamine (0.248 mol) was added, and the reaction heated for a period of 7 hours. The solid product was collected by filtration and washed with 2×100 mL of isopropanol to give 56.4 g of a yellow solid. Analysis (wt. %): C, 31.2; H, 5.3; N, 4.0; S 27.3.

Example 14

Into a 500 mL round-bottomed flask equipped with a mechanical stirrer and thermometer was added 22.5 g (0.156 mol) of $MoO_3$, 33.2 g (0.328 mol) of triethylamine, 33.2 g of n-propanol, and 20 g of water were added. The mixture was stirred and heated at 80° C. until all of the $MoO_3$ was in solution. The mixture was then cooled to 40° C., and 25.0 g of $CS_2$ (0.329 mol) was added by dropping funnel. The reaction was then maintained at 40-45° C. for 2 hours. 91% Ditridecylamine, 66.4 g (0.159 mol), was then added to the mixture and the temperature was increased to 80° C. and held for 3 hours. The temperature was then raised to 120° C., and the distillate was collected to give 87.2 g. At this time 50 g of mineral oil was added, and the mixture was held at 120° C. for 1 hour to assure loss of volatiles. The red-brown material was filtered through Celite to give 65.7 g of red-brown liquid. Analysis (wt. %): Mo, 11.1; S, 11.1.

Example 15

Into a 500 mL round-bottomed flask equipped with a mechanical stirrer and thermometer was added 45.0 g (0.313 mol) of $MoO_3$, 33.2 g (0.328 mol) of triethylamine, 66.4 g of n-propanol, and 40 g of water were added. The mixture was stirred and heated at 80° C. until all of the $MoO_3$ was in solution. The mixture was then cooled to 40° C., and 50.0 g of $CS_2$ (0.658 mol) was added by dropping funnel. The reaction was then maintained at 40-45° C. for 2 hours. 91% Ditridecylamine, 66.4 g (0.159 mol), was then added to the mixture and the temperature was increased to 80° C. and held for 3 hours. The temperature was then raised to 120° C., and 135.8 g of distillate was collected. At this time 100 g of mineral oil was added, and the mixture was held at 120° C. for 1 hour to assure loss of volatiles. The red-brown material was filtered through Celite to give 222.0 g of red-brown liquid. Analysis (wt. %): Mo, 10.7; S, 11.0.

Example 16

Into a 500 mL round-bottomed flask equipped with a mechanical stirrer and thermometer was added 22.5 g (0.156 mol) of $MoO_3$, 33.2 g (0.329 mol) of triethylamine, 33.2 g of n-propanol, and 20 g of water were added. The mixture was stirred and heated at 80° C. until all of the $MoO_3$ was in solution. The mixture was then cooled to 40° C., and 25.0 g of $CS_2$ (0.329 mol) was added by dropping funnel. The reaction was then maintained at 40-45° C. for 2 hours. 91% Ditridecylamine, 66.4 g (0.159 mol), and di-2-ethylhexylamine, 21.0 g (0.087 mol), was then added to the mixture and the temperature was increased to 80° C. and held for 3 hours. The temperature was then raised to 120° C., and 81.4 g of distillate was collected. At this time 50 g of mineral oil was added, and the mixture was held at 120° C. for 1 hour to assure loss of volatiles. The red-brown material was filtered through Celite to give 77.0 g of red-brown liquid. Analysis (wt. %): Mo, 10.6; S, 11.8.

Comparative Example 17

The comparative example is Sakuralube® 600, a solid Molybdenum oxysulfide dithiocarbamate manufactured by the Asahi Denka Company. This example contains 27.5% molybdenum and 29% sulfur, by weight.

Comparative Example 18

The comparative example is Sakuralube® 515, an oil-soluble Molybdenum oxysulfide dithiocarbamate manufactured by the Asahi Denka Company. This example contains 10% molybdenum and 11% sulfur, by weight.

Example 19

Cu Corrosion Testing

Copper corrosion testing was performed as per ASTM D-130, 24 h @ 121° C. in an Exxon Mobil Li-12 OH Grease at 3% concentration

| Reaction Product | Wt. % in Grease | Copper Corrosion |
|---|---|---|
| 8 | 3 | 2c |
| 9 | 3 | 3b |
| 10 | 3 | 3b |
| 11 | 3 | 3b |
| 12 | 3 | 3b |
| Comp. Ex. 17 | 3 | 3c |
| Base Grease | N/A | 1a |

Example 20

Grease Dropping Point

The grease dropping point was performed as per a modified ASTM 2265 method. This was performed in a Kyodo Yushi polyurea base grease manufactured by the Kyodo Yushi Co. Ltd.

| Reaction Product | Wt. % in Grease | Dropping Point, C. |
|---|---|---|
| 8 | 4 | 252 |
| 10 | 4 | 249 |
| 12 | 4 | 255 |
| Comp. Ex. 17 | 4 | 251 |
| Base Grease | N/A | 270 |

Example 21

Friction Testing in Grease

SRV testing was performed as per ASTM D5707 method, a ball on disc with a 1.00 mm stroke, 200 N, 50 Hz, at 80° C. for 1 hour. The grease used was Exxon-Mobil Lithium 21-OH, manufactured by Exxon-Mobil.

| Reaction Product | Wt. % in Grease | Final Friction |
|---|---|---|
| 4 | 3 | 0.12 |
| 5 | 3 | 0.10 |
| Comp. Ex. 17 | 3 | 0.10 |
| Base Grease | N/A | 0.16 |

Example 22

Cu Corrosion Testing in Oil

Copper corrosion testing was performed as per ASTM D-130, 24 h @ 121° C. in an Exxon ISO 220 Blend (Group I) Oil at 1% concentration.

| Reaction Product | Wt. % in Grease | Copper Corrosion |
|---|---|---|
| 14 | 1 | 3b |
| 15 | 1 | 3b |
| Comp. Ex. 18 | 1 | 3b |
| Base Oil | N/A | 1a |

Example 23

Friction Testing in Oil

SRV testing was performed as per ASTM D5707 method, a ball on disc with a 1.00 mm stroke, 200 N, 50 Hz, at 80° C. for 1 hour. The oil used was a prototype GF-4 partially formulated motor oil from Conoco.

| Reaction Product | ppm Mo | Final Friction |
|---|---|---|
| 14 | 700 ppm | 0.083 |
| 15 | 700 ppm | 0.083 |
| Comp. Ex. 18 | 700 ppm | 0.088 |
| Base Oil | N/A | 0.126 |

What is claimed is:

1. A process for preparing highly sulfurized molybdenum dithiocarbamates, comprising the steps of:

(a) combining:

[A] a tertiary amine

[B] a hexavalent molybdenum compound

[C] water

[D] carbon disulfide, and

[E] one or more secondary amines or secondary alkanolamine; and then (b) heating at a temperature between 40° and 120° Celsius for a period between 1 and 24 hours, wherein the molar ratio of reactants [A]/[B]/[D]/[E] is about 0.25-5.0/1.0/1.5-5.0/1.0-3.0.

2. The process of claim 1, wherein step (a) comprises first combining components [A], [B], [C] and [E], followed by the addition of component [D].

3. The process of claim 2, further comprising the step of, after step (b), heating to a temperature between 90 and 150° C. for a period of between 1 and 10 hours.

4. The process according to claim 1, wherein the molar ratio of reactants [A]/[B]/[D]/[E] is about 0.25-3.0/1.0/1.5-3.0/1.0-2.0.

5. The process according to claim 4, wherein the molar ratio of reactants [A]/[B]/[D]/[E] is about 0.55/1.0/1.6/1.05.

6. The process according to claim 1 wherein [A] is a tertiary amine with alkyl groups each containing between 1 and 60 carbon atoms.

7. The process according to claim 6 wherein [A] is chosen from the group consisting of triethylamine, tributylamine and dimethylethanolamine.

8. The process according to claim 1 wherein [B] is chosen from the group consisting of $MoO_3$, ammonium molybdate and ammonium heptamolybdate.

9. The process according to claim 1 wherein [E] is a secondary amine with both alkyl groups containing between 1 and 60 carbon atoms, the alkyl groups being the same or different.

10. The process according to claim 9, wherein [E] is chosen from the group consisting of one or more in combination of dibutylamine, ditridecylamine, di-2-ethylhexylamine and diamylamine.

11. A process for preparing a lubricant composition comprising adding a molybdenum oxysulfide dithiocarbamate which is produced by the process according to claim 1 in an amount of 0.1-10% to a lubricating base oil or grease.

12. A process for preparing highly sulfurized molybdenum dithiocarbamates, comprising the steps of, in order:

(1) reacting [A] a tertiary amine, [B] a hexavalent molybdenum compound and [C] water, at a temperature between 15° and 100° Celsius for a period between 15 minutes and 4 hours, to form a first reaction mixture;

(2) reacting [D] carbon disulfide with the first reaction mixture at a temperature between 15° and 100° Celsius, for a period between 1 and 6 hours, to form a second reaction mixture; and (3) reacting [E] one or more secondary amines or secondary alkanolamines with the second reaction mixture at a temperature between 40° and 120° Celsius for a period between 1 and 10 hours.

13. The process according to claim 12, wherein the molar ratio of reactants [A]/[B]/[D]/[E] is about 0.25-5.0/1.0/1.5-5.0/1.0-3.0.

14. The process according to claim 13, wherein the molar ratio of reactants is [A]/[B]/[D]/[E] is about 1.0-3.0/1.0/1.6-2.5/1.05-1.25.

15. The process according to claim 14, wherein the molar ratio of reactants is [A]/[B]/[D]/[E] is about 2.0/1.0/2.0/1.05.

16. The process according to claim 12, wherein [E] is chosen from the group consisting of dibutylamine, dipentylamine, diamylamine, diisobutylamine, diisopropylamine, di-n-propylamine, and wherein (original) The process further comprises isolating the dithiocarbamate formed by the reaction by filtering, and recovering [A] and [C].

17. The process according to claim 16, further comprising using the recovered [A] and [C] as reactants in the main reaction.

18. A process for preparing a lubricant composition comprising adding a molybdenum oxysulfide dithiocarbamate which is produced by the process according to claim 12 in an amount of 0.1-10% to a lubricating base oil or grease.

* * * * *